US006102735A

United States Patent [19]

Chen et al.

[11] Patent Number: 6,102,735

[45] Date of Patent: Aug. 15, 2000

[54] FASTENER FOR A PRINTED CIRCUIT BOARD MOUNTED CONNECTOR

[75] Inventors: Spencer Chen, Taipei; Thomas R. L. Tsai, Tu-Chen, both of Taiwan

[73] Assignee: Hon Hai Precision Ind. Co., Ltd., Taipei Hsien, Taiwan

[21] Appl. No.: 09/223,037

[22] Filed: Dec. 30, 1998

[51] Int. Cl.[7] ..... H01R 13/73

[52] U.S. Cl. ..... 439/573

[58] Field of Search ..... 411/508–510, 551, 411/552, 553; 439/571, 573, 564, 559

[56] References Cited

U.S. PATENT DOCUMENTS 5,464,355 11/1995 Rothenberger ..... 439/559

*Primary Examiner*—Gary F. Paumen
*Assistant Examiner*—Phuongchi Nguyen
*Attorney, Agent, or Firm*—Wei Te Chung

[57] ABSTRACT

A printed circuit board mounted connector which employs separate fasteners for securing the connector to elongate mounting holes of the board. The fastener has an upper cap and a lower non-circular threaded rod. The insulative housing of the connector has a pair of side flanges. Each flange has a stepped through-hole, consisting of an upper hole for receiving the upper cap of the fastener and a lower non-circular hole for receiving the lower non-circular threaded rod of the fastener, and a number of protrusions on an interior wall of the upper hole. The protrusion has an inclined top surface which assist in a turning movement of the upper cap of the fastener within the upper hole of the flange. The lower non-circular threaded rod is dimensioned to be rotatable about a certain angle within the lower non-circular hole of the flange until contacting and thus engaging an interior wall of the lower non-circular hole.

11 Claims, 4 Drawing Sheets

FASTENER FOR A PRINTED CIRCUIT BOARD MOUNTED CONNECTOR

BACKGROUND OF THE INVENTION

The present invention relates to printed circuit board mounted electrical connectors, and more particularly to fasteners for positioning and retaining such connectors on printed circuit boards.

Fasteners for holding electrical connectors against printed circuit boards generally perform the tasks of holding solder tails of electrical contacts of the connectors in position against pads on the printed circuit boards during solder reflow as well as resisting board distortion and connector movement so that reliable solder joints form between the tails and pads. The fasteners also provide strain relief to protect the solder joints from breaking due to external forces such as those occurred during handling.

U.S. Pat. No. 4,907,987 issued on Mar. 13, 1990 discloses an electrical connector including a boardlock for mounting to a printed circuit board by an interference fit. The boardlock has a first portion for securing to the connector housing and a second portion for inserting into a boardlock-receiving aperture provided in the printed circuit board. The second portion of the boardlock has barb means thereon to engage interior wall of the boardlock-receiving aperture. In this design, it is noted that the insertion direction of the barb means when the boardlock is inserted into the boardlock-receiving aperture and the possible separation direction of the boardlock from the boardlock-receiving aperture are essentially co-linear.

U.S. Pat. No. 5,316,500 issued on May 31, 1994 discloses a fastener for holding a printed circuit board mounted connector without protruding through opposite surface of the board or requiring an excessive insertion force. This is achieved by a fastener comprising a clip rigidly supported by the connector body and a wedge supported by the connector body for sliding movement along the clip. This design involves provision of two separate elements, namely, the clip and the wedge, as well as the use of the wedge to urge the clip to engage with an inner surface of the hole provided on a printed circuit board.

There exists a need for a fastener with sufficient retention force to hold a printed circuit board mounted connector while is simple in construction and can apply to a variety of board widths.

BRIEF SUMMARY OF THE INVENTION

A main object of the present invention is to provide an electrical connector for mounting to a printed circuit board having elongated mounting holes, comprising: an insulative housing having a pair of flanges, each flange having a stepped through-hole and a plurality of protrusions, the stepped through-hole including an upper hole and a lower non-circular hole, the plurality of protrusions being formed on an interior wall of the upper hole and each having an inclined top surface; and a pair of fasteners each comprising an upper cap and a lower non-circular threaded rod, the upper cap bearing against the inclined top surface and being rotatable within the upper hole to effectuate a downward movement, the lower threaded rod being downwardly moveable with the upper cap and rotatable within the lower non-circular hole to effectuate a threading engagement with an interior wall of the mounting hole of the printed circuit board.

Preferably, the lower non-circular threaded rod has a threaded end engaging the mounting hole of the printed circuit board with at least two turns of screws thereof.

Other objects, advantages and novel features of the invention will become more apparent from the following detailed description when taken in conjunction with the accompanying drawings.

DETAILED DESCRIPTION OF THE INVENTION

Figure 1:
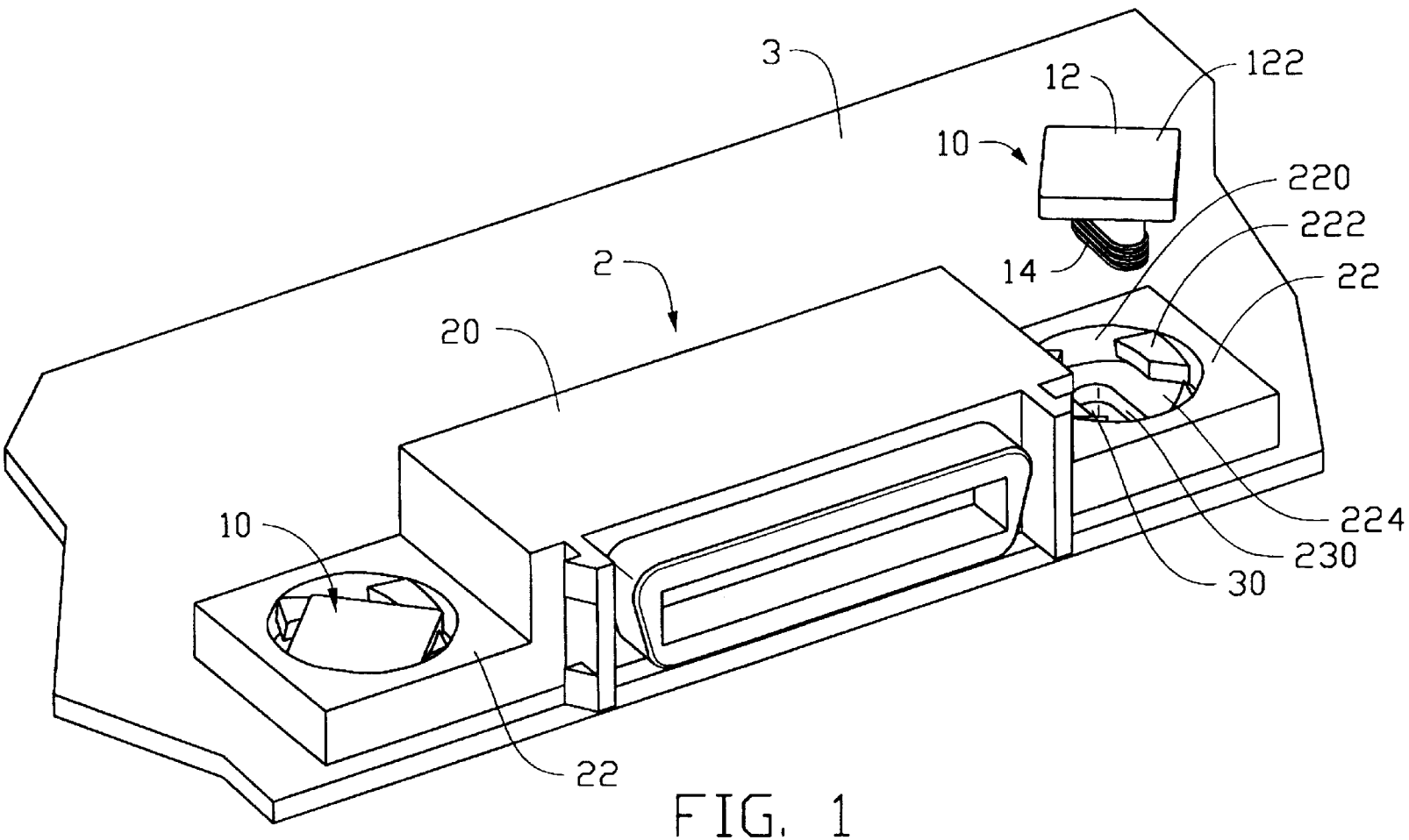
FIG. 1 is a perspective view of an electrical connector mounted to a printed circuit board in accordance with the present invention.
Figure 2:
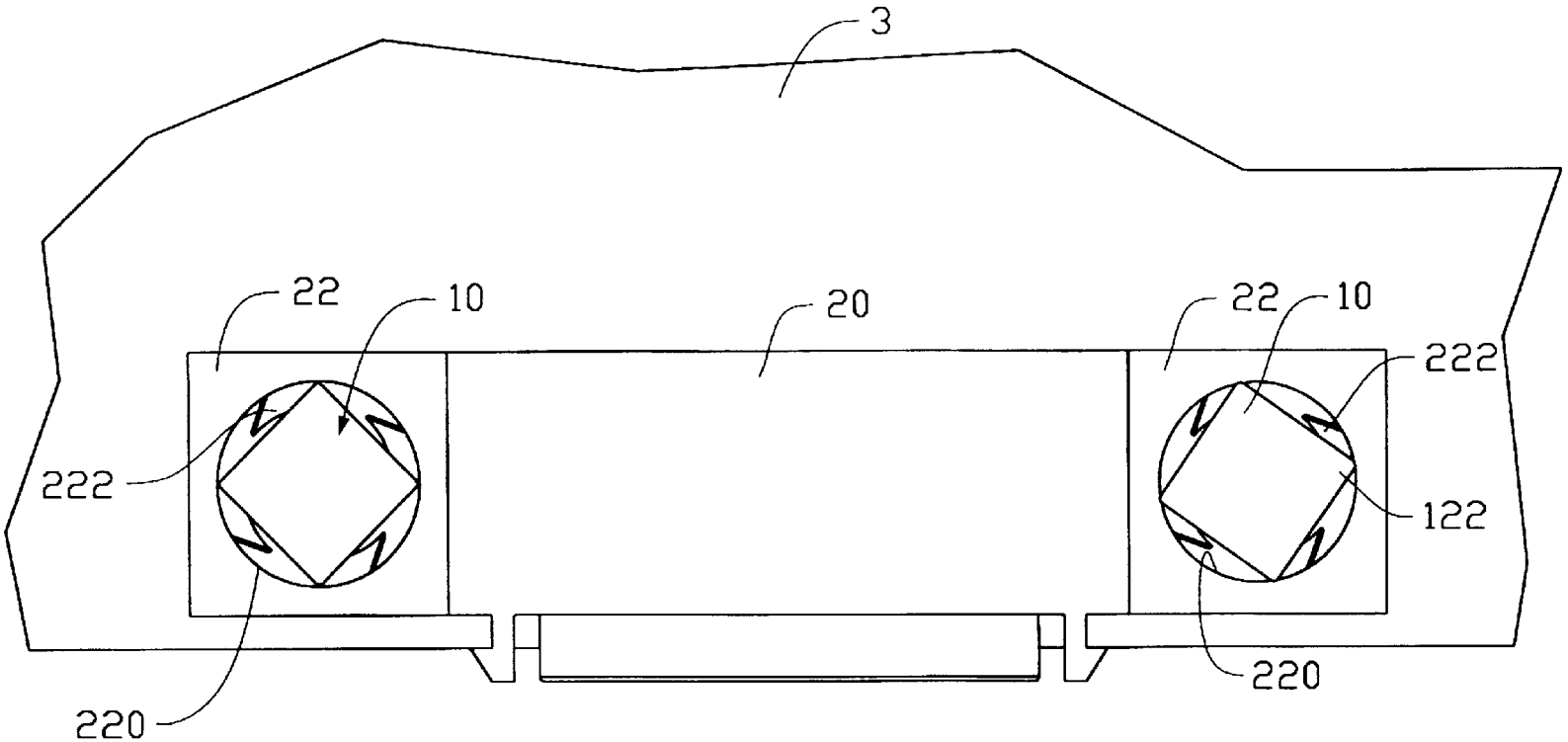
FIG. 2 is a top plan view of the connector shown in FIG. 1.

Referring to the drawings and initially to FIGS. 1 and 2, an electrical connector 2 of the invention is constructed for mounting on a printed circuit board 3. As will be clear from the following descriptions, the board 3 is provided with non-circular mounting holes 30, as is frequently the case. The connector 2 comprises an insulative housing 20 having a pair of flanges 22 and a pair of fasteners 10 cooperating with the flanges 22 to firmly secure the insulative housing 20 to the printed circuit board 3. Each flange 22 has a stepped through-hole consisting of an upper hole 220 and a lower hole 230 and has a plurality of abutting protrusions 222 formed on an interior wall of the upper hole 220. The protrusion may be suitably formed on either the side wall of or the bottom wall 224 of the upper hole 220. In this embodiment, there are four protrusions 222 equal-angularly disposed. The lower hole 230 is non-circular in cross-section. Preferably, the hole 230 is elliptical. Each protrusion 222 has an inclined top surface.

The fastener 10 is composed of an upper cap 12 and a lower threaded engagement rod 14. Like the non-circular lower hole 230, the lower threaded rod 14 also has a non-circular contour but is of a smaller outside dimension so that it can rotate or turn within the non-circular lower hole 230. When the fastener 10 is inserted into the stepped through-hole, the upper cap 12 bears against the inclined top surfaces of the protrusions 222. Subsequent rotate or turning movement of the fastener 10 within the stepped through-hole will effectuate a downward movement of the upper cap 12 along the inclined top surfaces of the protrusions 222. With the downward movement of the upper cap 12, the lower threaded rod 14 connected therewith will also downwardly moved while rotating within the lower non-circular hole 230 to effectuate a threading engagement with an interior wall of the mounting hole 30 of the printed circuit board 3.

As is required, the upper cap 12 has an outside dimension which is slightly less than an outside dimension of the upper hole 220. Further, the upper cap 12 is substantially rectangular to define four corners 122. When the fastener 10 is initially put into the stepped through-hole with the major axis of the lower non-circular hole 230 aligned with the major axis of the non-circular lower hole 230, each corner 122 of the each just rests upon the inclined top surface of a corresponding protrusion 222.

Preferably, the lower non-circular threaded rod 14 is so dimensioned as to be rotatable about 10 to 15 degrees within the lower non-circular hole 230 of the flange 22 until it contacts an interior wall of the lower non-circular hole 230. In FIG. 2, the fastener 10 on the left-hand side (as viewed from the drawing figure) is shown in a locking configuration of having been turned in a clockwise direction, contrast to the fastener 10 on the right-hand side shown in a free configuration of just being put into the stepped through-hole.

Figure 3:
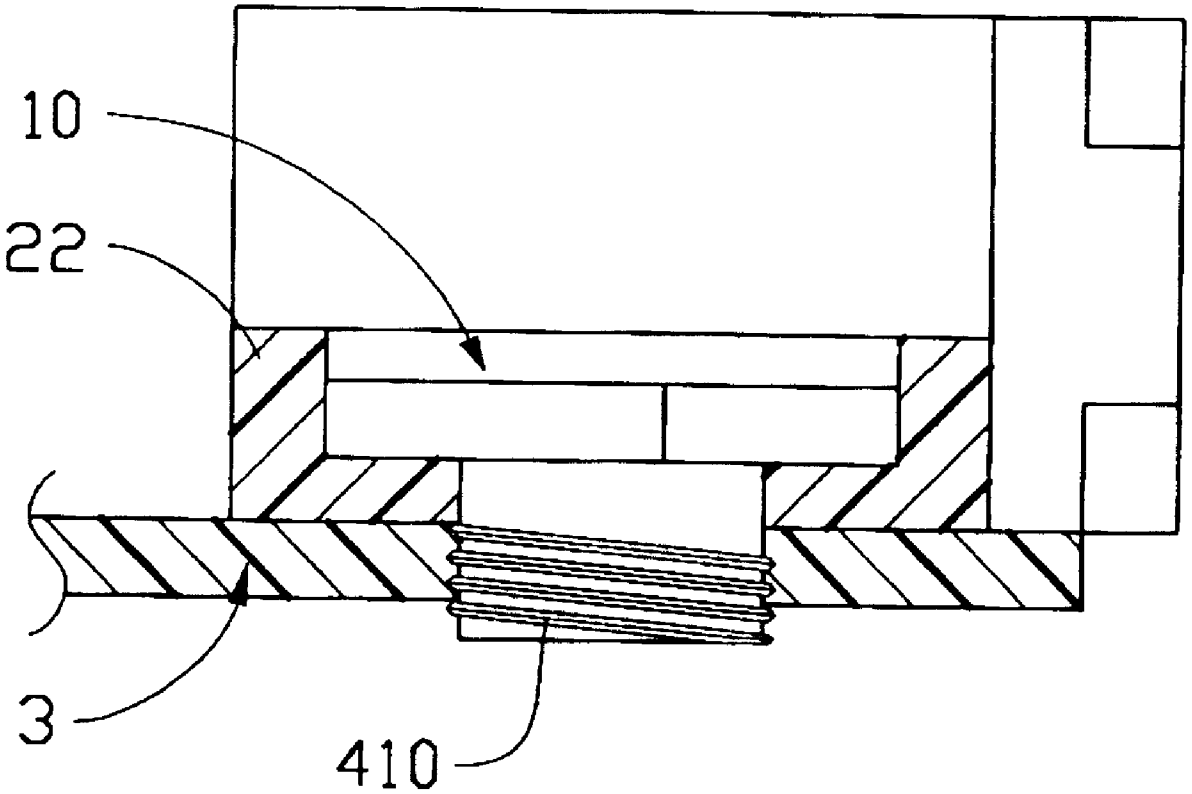
FIG. 3 is a partly cut-away, cross-sectional view showing a fastener in accordance with the present invention for mounting the connector to the printed circuit board.
Figure 4:
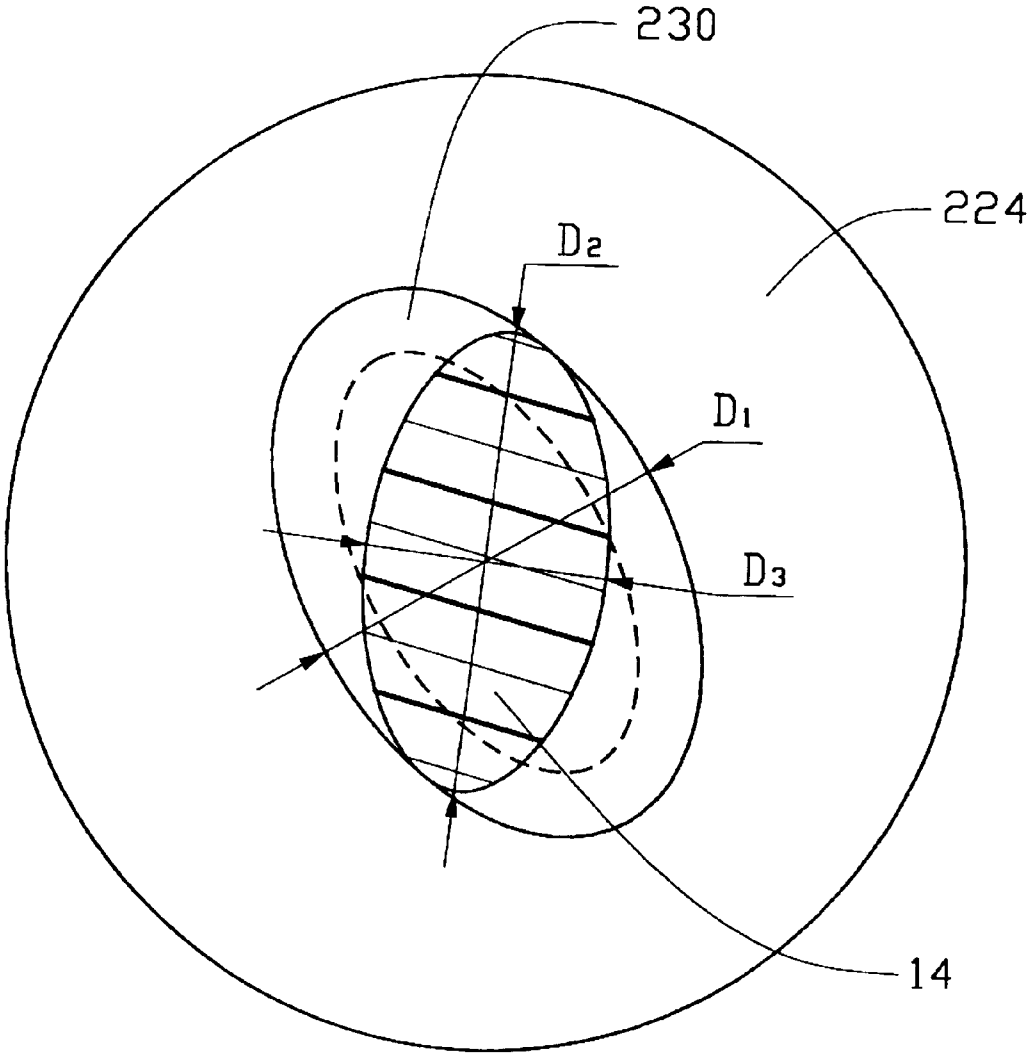
FIG. 4 is a schematic view showing a final position of a lower rod of the fastener in a hole of a connector housing of the electrical connector after the fastener is rotated.

FIG. 3 shows that the fastener 10 firmly secured to the printed circuit board 3 by way of the threaded end of the lower non-circular threaded rod 14 engaging with an interior wall of the board 3. It is noted that the threaded end of the lower non-circular threaded rod 14 will cut into the interior wall of the board 3 to create a secure connection. In accordance with the above description, best shown in FIG. 4, to effectuate a desired engagement, the elliptical lower non-circular hole 230 of the flange 22 will have a minor axis (dimension $D_1$) and the lower non-circular threaded rod 14 will have a maximum outside dimension $D_2$ and a minimum outside dimension $D_3$ where the dimension $D_1$ of the minor axis is in a range intermediate of the maximum and minimum outside dimensions $D_2$, $D_3$. At a beginning status, the threaded rod 14 is capable of being inserted into the lower non-circular hole 230, and at a final status after the fastener 10 is rotated, the threaded rod 14 reaches the final position due to its maximum outside dimension $D_2$ being larger than the dimension $D_1$ of the minor axis. Preferably, the threaded end of the lower non-circular threaded rod 14 engages the mounting hole 30 of the printed circuit board 3 with at least two turns of screws 410 thereof. With the design of inclined top surfaces on the upper cap 12, guided engagement is insured and inadvertent loosening is prevented.

It can be understood that the optional additional alignment posts may extend downward from the housing for reception within the corresponding additional alignment holes in the printed circuit board so as to assure the relative horizontal position of the connector with regard to the printed circuit board. Under this situation, the fasteners are only concerned about the retention of the connector with regard to the printed circuit board in the vertical direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a printed circuit board having elongated mounting holes, comprising:

an insulative housing having a pair of flanges, each flange having a stepped through-hole and a plurality of protrusions, the stepped through-hole including an upper hole and a lower non-circular hole, the plurality of protrusions being formed on an interior wall of the upper hole and each having an inclined top surface; and a pair of fasteners each comprising an upper cap and a lower non-circular threaded rod, the upper cap bearing against the inclined top surface and being rotatable within the upper hole to effectuate a downward movement, the lower threaded rod being downwardly moveable with the upper cap and rotatable within the lower non-circular hole to effectuate a threading engagement with an interior wall of the mounting hole of the printed circuit board.

2. The electrical connector as claimed in claim 1, wherein the upper cap has an outside dimension slightly less than an outside dimension of the upper hole.

3. The electrical connector as claimed in claim 1, wherein there are four protrusions and the upper cap is substantially rectangular to define four corners each resting upon the inclined top surface of a corresponding protrusion.

4. The electrical connector as claimed in claim 1, wherein the lower non-circular threaded rod is dimensioned to be rotatable about 10 to 15 degrees within the lower non-circular hole of the flange until contacting an interior wall of the lower non-circular hole.

5. The electrical connector as claimed in claim 1, wherein the lower non-circular hole is elliptical.

6. The electrical connector as claimed in claim 5, wherein the elliptical lower non-circular hole of the flange has a minor axis and the lower non-circular threaded rod has a maximum outside dimension and a minimum outside dimension, a dimension of the minor axis being intermediate of the maximum and minimum outside dimensions.

7. The electrical connector as claimed in claim 1, wherein the lower non-circular threaded rod has a threaded end engaging the mounting hole of the printed circuit board with at least two turns of screws thereof.

8. An electrical connector assembly comprising:

an electrical connector including an insulative housing defining at least a through hole;

at least a fastener comprising an upper cap and a lower non-circular engagement rod;

a printed circuit board defining an elongated mounting hole and positioned under the connector with the elongated mounting hole being aligned with the through hole of the connector; wherein the non-circular engagement rod of the fastener is inserted through the through hole of the connector and the aligned elongated mounting hole of the printed circuit board without interfering with the through hole and the mounting hole and, after insertion, the engagement rod is rotated through an angle to retainably engage with an inner wall of the elongated mounting hole of the printed circuit board and to have the cap abut against the connector, thereby fastening the connector to the printed circuit board.

9. The connector assembly as claimed in claim 8, wherein the engagement rod is equipped with threads thereon.

10. The connector assembly as claimed in claim 8, wherein the connector includes a plurality of protrusions formed around said through hole.

11. The connector assembly as claimed in claim 10, wherein the protrusions are formed on an interior wall of the through hole and each protrusion has an inclined top surface.

* * * * *